US006179700B1

(12) United States Patent
Lalone et al.

(10) Patent No.: US 6,179,700 B1
(45) Date of Patent: Jan. 30, 2001

(54) MECHANISM FOR HONING NON ROUND CYLINDER BORES AND MACHINE ADAPTER ASSEMBLY

(75) Inventors: Barry G. Lalone, Oxford; Andrew Leslie Bartos, Clarkston; Yhu-Tin Lin, Rochester Hills, all of MI (US)

(73) Assignee: General Motors Corporation, Detroit, MI (US)

( * ) Notice: Under 35 U.S.C. 154(b), the term of this patent shall be extended for 0 days.

(21) Appl. No.: 09/311,873

(22) Filed: May 14, 1999

(51) Int. Cl.[7] ..... B24B 9/02

(52) U.S. Cl. ..... 451/464; 451/470; 451/23

(58) Field of Search ..... 451/464, 463, 451/470, 472, 476, 478, 473, 474, 23, 51, 61, 180, 155, 157

(56) References Cited

U.S. PATENT DOCUMENTS 3,774,346 * 11/1973 Lin et al. ..... 451/457
3,812,574 * 5/1974 Jones et al. ..... 29/560
3,884,789 * 5/1975 Czubak ..... 204/224 R
3,922,819 * 12/1975 Bender et al. ..... 51/101 R
4,346,534 * 8/1982 Czubak ..... 51/34 A
5,201,618 * 4/1993 Malarz et al. ..... 409/132
5,681,210 * 10/1997 Lin et al. ..... 451/457

* cited by examiner

*Primary Examiner*—Timothy V. Eley
*Assistant Examiner*—Dung Van Nguyen
(74) *Attorney, Agent, or Firm*—Karl F. Barr, Jr.

(57) ABSTRACT

A mechanism for honing non round cylinder bores includes a tool body rotatable around a nonrotatable cam with a non round peripheral cam surface and a plurality of honing stones carried by supports for generally radial movement in the tool body. In a preferred embodiment, the supports are swing arms pivotally mounted so that the honing stones follow generally radially oriented arcuate paths determined by cam followers carried by the swing arms. A separately controlled expansion actuating rod axially adjusts expansion shoes that wedge outward stone shoes carried by the swing arms to progressively remove stock from the cylinder and to compensate for wear of the honing stones. Assembly with an associated machine adapter supports the honing mechanism and connects with a conventional honing machine to drive and orient the assembly for accurately honing non round cylinder bores.

11 Claims, 5 Drawing Sheets

MECHANISM FOR HONING NON ROUND CYLINDER BORES AND MACHINE ADAPTER ASSEMBLY

TECHNICAL FIELD

This invention relates to mechanisms for honing non round cylinder bores and to an adapter for connecting the honing mechanism with a conventional honing machine.

BACKGROUND OF THE INVENTION

Various mechanisms have been used for honing the bores of elliptical and other non round cylinders used in a few internal combustion engines and potentially usable in other devices. Some of these mechanisms apply constant hydraulic pressure in the process of metal removal. This method has a tendency to follow the original bore geometry rather than correcting it to a desired configuration. Some methods employ three dimensional grinding which generally requires excessive cycle time for commercial production use. U.S. Pat. No. 5,681,210, assigned to the assignee of the present invention, describes a mechanism including a barrel cam external to a conventional honing machine as the principal actuator for the contouring and expansion of honing stones.

SUMMARY OF THE INVENTION

The present invention provides a honing mechanism in which a precision camshaft is located inside a tool body to minimize the actuation linkage and directly drive the honing stones in an elliptical or other desired non round contour as they revolve around the camshaft. A separate vertically movable actuator rod drives expansion shoes that cam associated stone carrying shoes outward and provide steady, high pressure with a small expansion movement for progressively removing stock as well as for stone wear compensation. Preferably, the honing stones are carried on swing arms which facilitate a large and rapid reciprocating movement of the honing stones and their assemblies. A center fed coolant passage feeds coolant to the internal mechanism, which has limited external communication, to maintain an outward coolant flow that keeps chips and abrasive from entering the enclosure and minimizes wear of the precision actuating members.

These and other features and advantages of the invention will be more fully understood from the following description of certain specific embodiments of the invention taken together with the accompanying drawings.

DESCRIPTION OF THE PREFERRED EMBODIMENT

Figure 1:
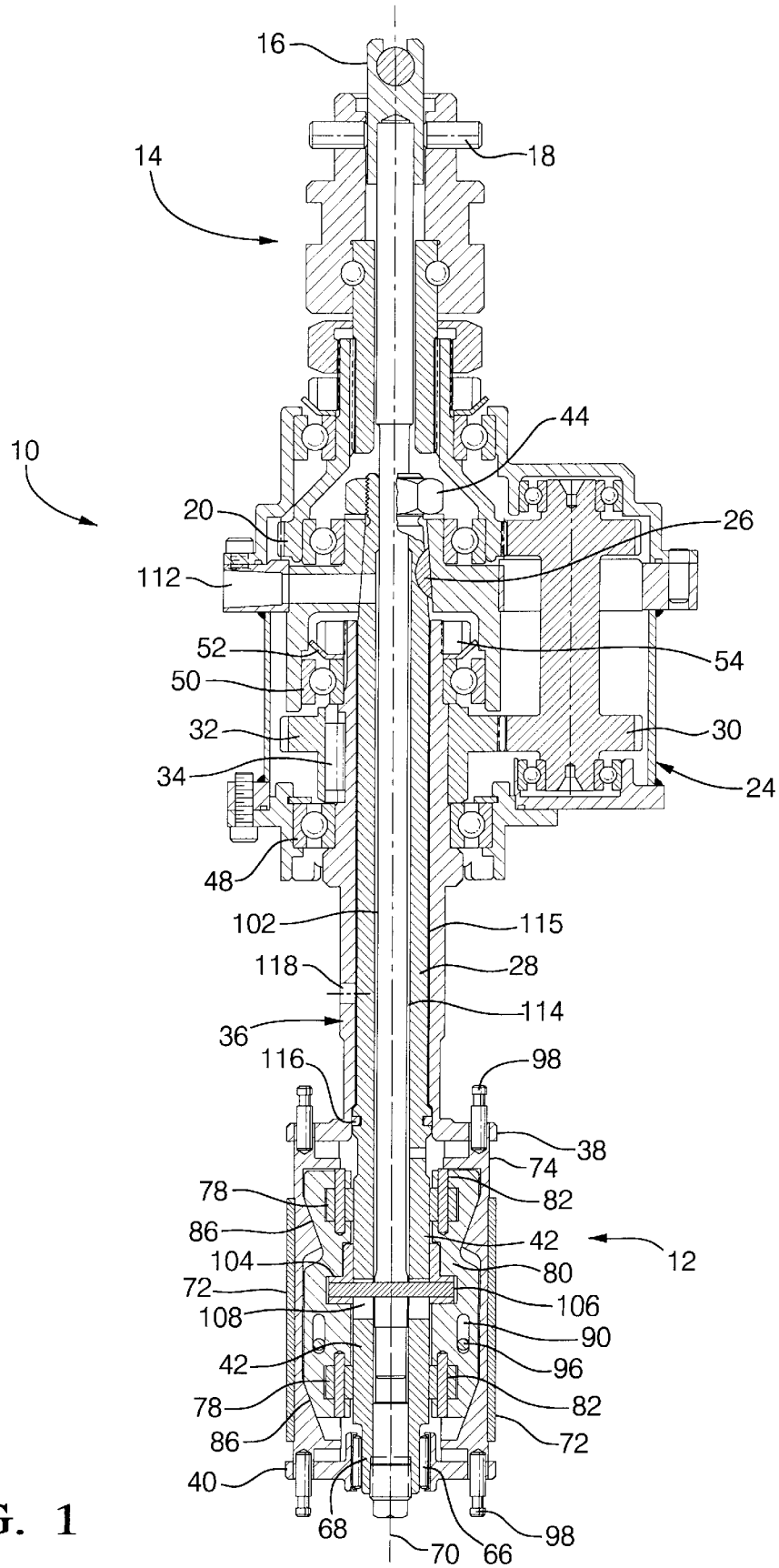
FIG. 1 is a cross-sectional view through the central axis of a combined honing mechanism and machine adapter assembly according to the invention.
Figure 2:
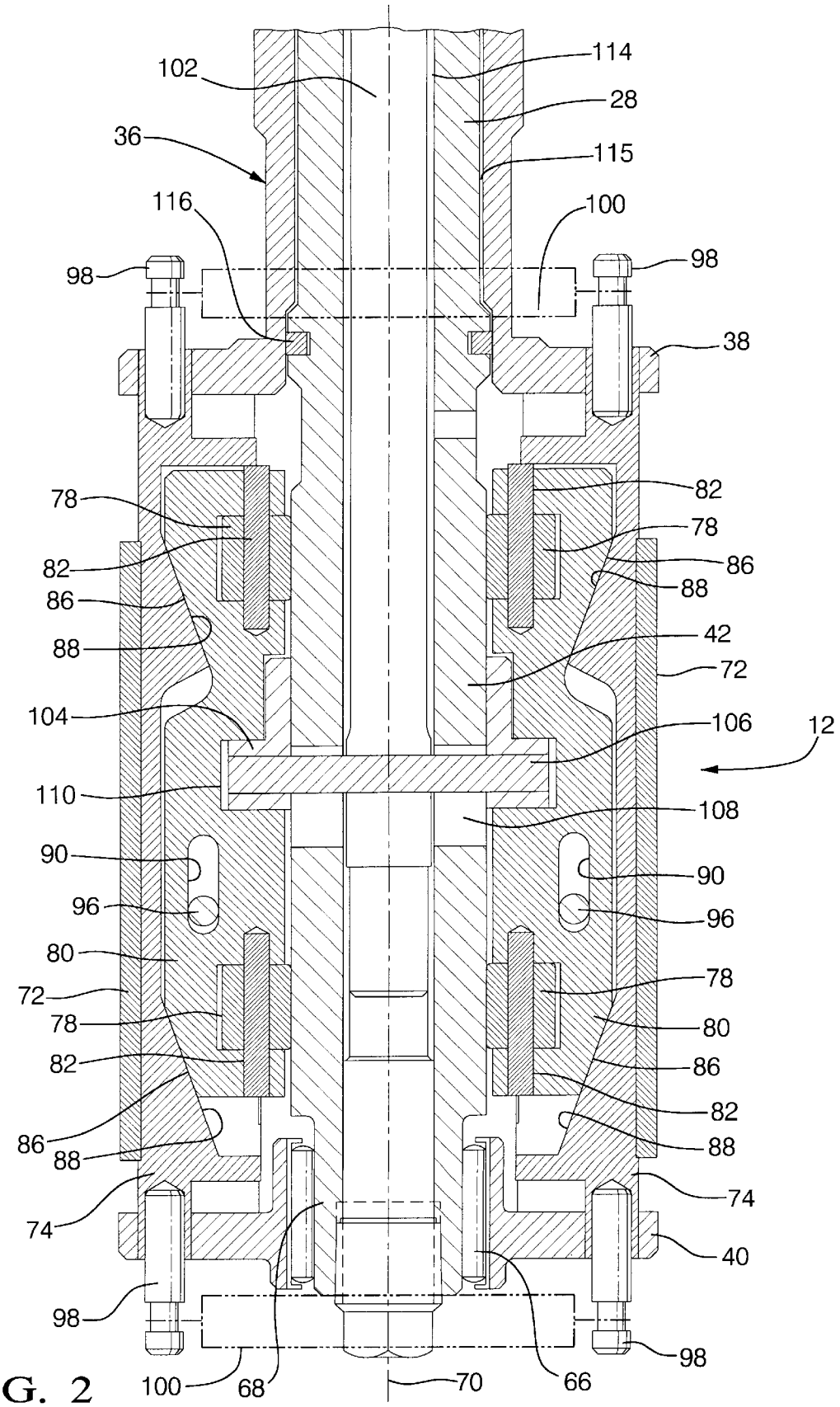
FIG. 2 is an enlarged cross-sectional view of the honing mechanism in the assembly of FIG. 1.
Figure 3:
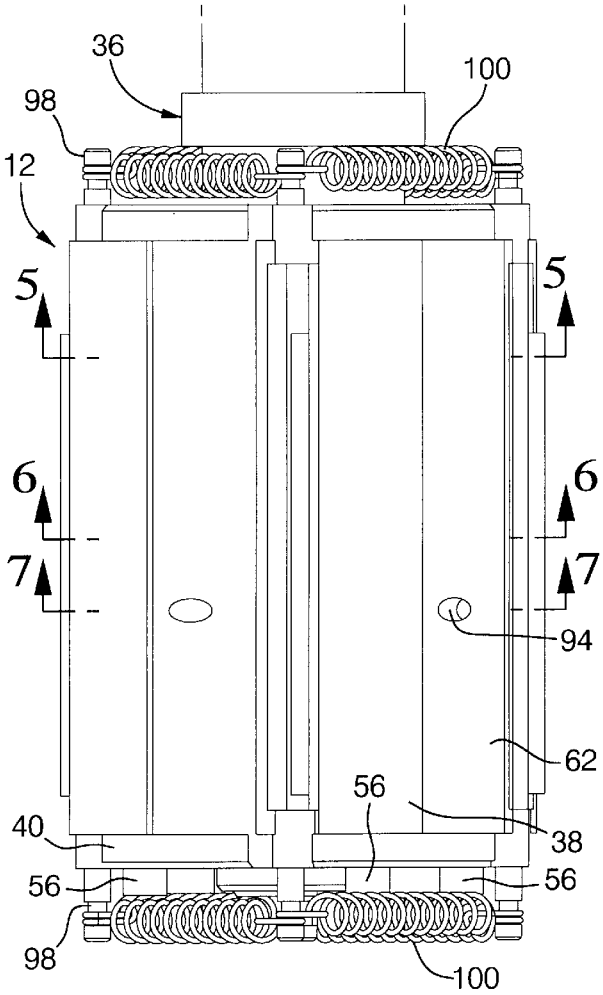
FIG. 3 is an external side view of the honing mechanism of FIG. 2.
Figure 5:
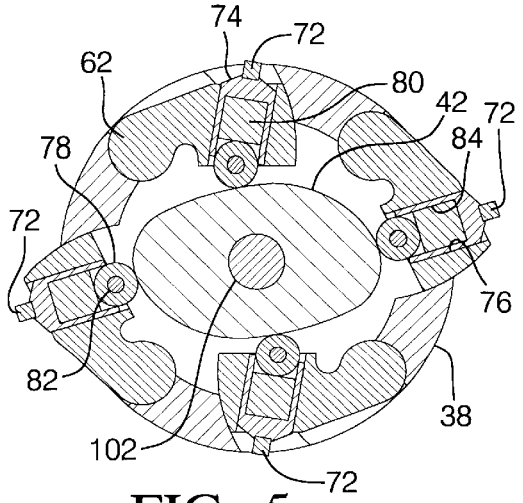
FIG. 5 is a transverse cross-sectional view from the line 5—5 of FIG. 3.
Figure 6:
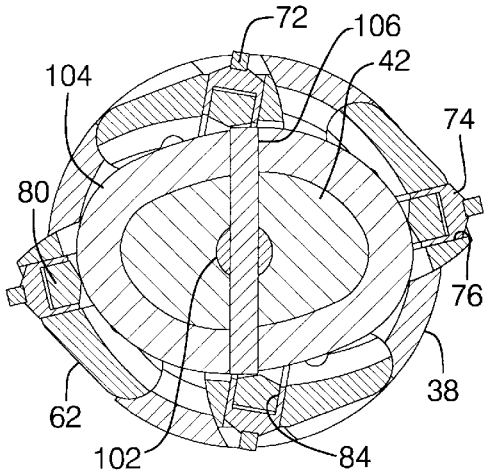
FIG. 6 is a transverse cross-sectional view from the line 6—6 of FIG. 3.

Referring first to FIG. 1 of the drawings in detail, numeral 10 generally indicates an assembly of a mechanism 12 for honing non round cylinder bores and a machine adapter 14 for driving the mechanism and connecting the assembly with a commercial honing machine, not shown, having a tool size adjustment capability concentrically located inside the honing machine spindle. The adapter 14 includes a stationary central connector 16 and a surrounding rotatable coupling 18. The coupling is adapted to be supported by and rotatably connected with a drive spindle, not shown, of the associated honing machine.

Coupling 18 is connected with a gear 20 that is rotatably supported by bearings in a stationary gearbox 24. In use, the gearbox 24 is attached to the honing machine frame, not shown, in a manner that allows it to move vertically on guide rods, not shown, but prevents it from rotating. Gearbox 24 is connected by a key 26 with a hollow camshaft 28 of the honing mechanism 12, to be subsequently described, and thus holds the camshaft against rotation relative to the gearbox 24.

Rotatable gear 20 is drivably connected through an offset gear cluster 30 with a drive gear 32. The drive gear is, in turn, drivably connected by a key 34 with a hollow tool body 36 forming part of the honing mechanism 12. The tool body 36 is formed as a hollow shaft which is rotatably supported on bearings within the gearbox 24 of the machine adapter 14.

Referring additionally to FIGS. 2–8 of the drawings, the lower end of the tool body 36 is expanded outward to form a cylindrical housing 38 having an open lower end closed by a retainer plate 40.

Mechanism 12 includes a stationary cam 42 forming the lower end of the hollow camshaft 28 and rigidly supported in gearbox 24 by a hex nut 44. Stationary cam 42 and hollow camshaft 28 are indexed with respect to the honing machine, not shown, by key 26. The profile of stationary cam 42 is generated for a unique non round cylinder bore size and shape. The geometric relationship of other parts in the mechanism 12 influences the profile of the stationary cam 42, and causes its profile to be different from that of the resulting cylinder bore.

The rotating tool body 36 is located around stationary cam 42 and hollow camshaft 28. Ball bearings 48 and 50 are mounted on and secured to tool body 36 by lock washer 52 and bearing lock nut 54. Ball bearings 48 and 50 are, in turn, located in respective bores in gearbox 24. Tool body 36 is driven by gear 32 through the gears 30, 20 from the coupling 18. In this manner, machine adapter 14 transmits a rotating input, which is inside the grounding members (gearbox 24), to a rotating output (tool body 36) which is outside the grounding members (hollow camshaft 28 and stationary cam 42).

Figure 4:
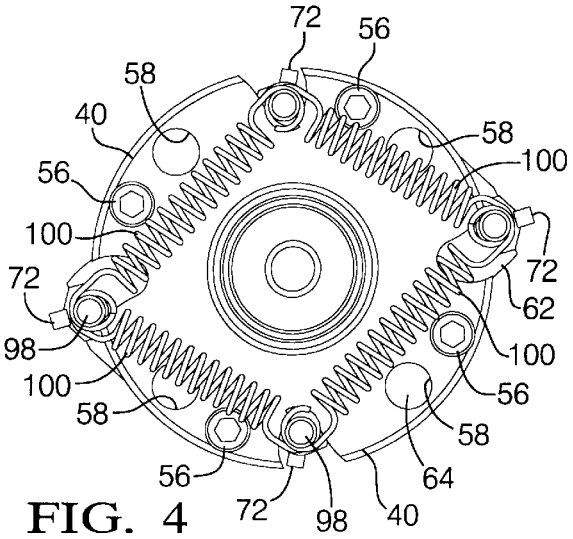
FIG. 4 is a lower end view of the honing mechanism of FIG. 3.
Figure 7:
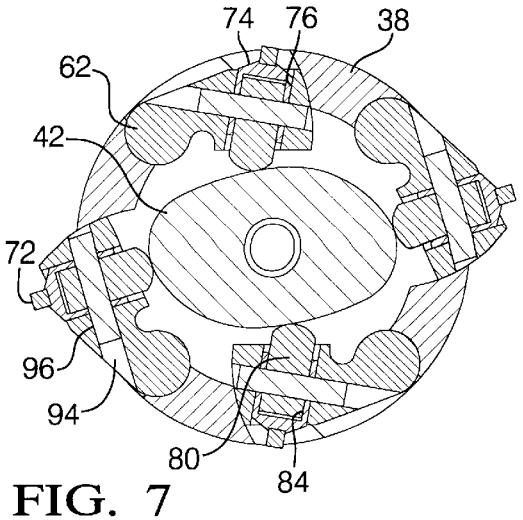
FIG. 7 is a transverse cross-sectional view from the line 7—7 of FIG. 3.
Figure 8:
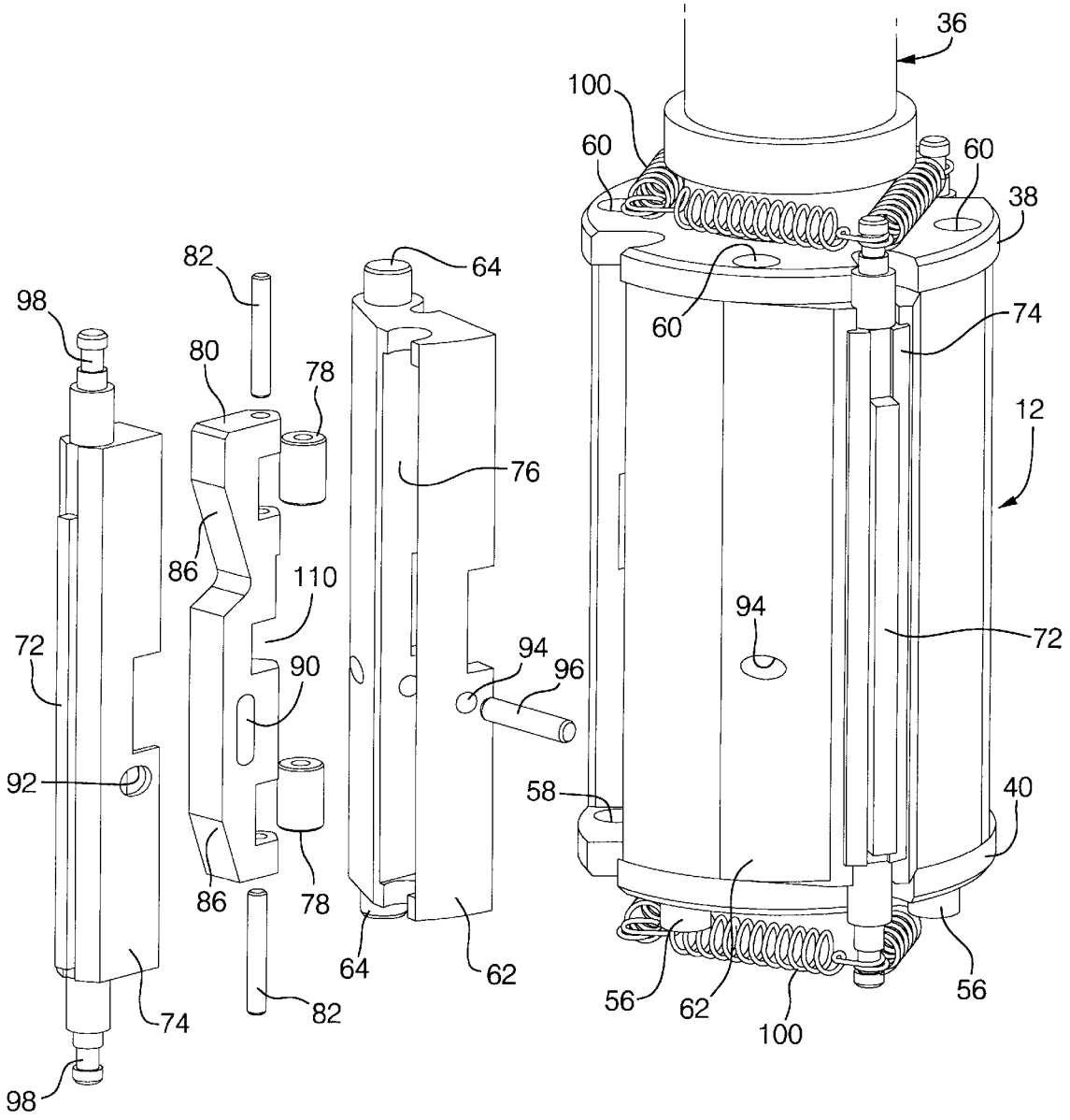
FIG. 8 is a partially exploded pictorial view showing construction of the swing arm assemblies.

Retainer plate 40 attaches to the bottom of tool body 36 with four screw fasteners 56 (FIG. 4). Additionally, retainer plate 40 contains four equally spaced holes 58 that are in line with four equally spaced holes 60 (FIG. 8) in tool body 36.

Four swing arms 62 are press fitted with a protruding pin 64 at each end. Two pins 64 are positioned in line and form an axis of rotation for each swing arm 62. The upper pin 64 fits into one of the four equally spaced holes 60 in tool body 36. Lower pin 64 fits into the opposing hole 58 in retainer plate 40. When installed in housing 38 of tool body 36, the four swing arms 62 are free to pivot about their respective axes.

A needle bearing 66 is press fitted into the center of retainer plate 40. A bearing race 68 on the lower end of hollow camshaft 28 is piloted inside of needle bearing 66. Needle bearing 66 maintains a coaxial relationship between the axis 70 of stationary cam 42 and the housing 38 of tool body 36.

Using current bonding practices, a honing stone 72 is attached to each stone shoe 74 which, in turn, is slip fitted into a rectangular opening 76 in each swing arm 62. Two cam follower rollers 78 are rotatably mounted in each of four expansion shoes 80 on cam roller pins 82. Each expansion shoe 80 slip fits into a pocket 84 in stone shoe 74. Two wedge surfaces 86 on the outside of each expansion shoe 80 cooperate with two similar wedge surfaces 88 on the inside pocket of each stone shoe 74.

When assembled, a vertical slot 90 in each expansion shoe 80, a horizontal slot 92 in each stone shoe 74, and a hole 94 in the respective swing arm 62, are all in line. A shoe retaining pin 96 is press fitted into hole 94 in each swing arm 62 and slip fitted through horizontal slot 92 in the associated stone shoe 74 and vertical slot 90 in associated expansion shoe 80. The shoe retaining pin 96 ensures that swing arm 62 moves in unison with its expansion shoe 80. Any change in distance between the axis of cam follower pin 82 (on expansion shoe 80) and the axis of rotation of swing arm 62 would cause a change in the geometric relationship used to generate the profile of stationary cam 42. Consequently, the profile of the cylinder being honed would be changed.

The top and bottom of each stone shoe 74 is press fitted with a spring anchor pin 98. An extension spring 100 is connected between each pair of adjacent spring anchor pins 98 forming a closed "parallelogram " at both the top and bottom of the non round cylinder bore honing mechanism 12. The eight extension springs 100 keep all four pairs of cam follower rollers 78 in contact with the stationary cam 42. Additionally, the extension springs 100 retain all four stone shoes 74 within their respective swing arms 62.

As tool body 36 is driven in a clockwise direction (when viewed from the top) by the honing machine spindle through machine adapter 14, the two cam follower rollers 78 on each expansion shoe 80 follow the profile of the stationary cam 42. The two cam follower rollers 78 are mounted to expansion shoe 80, which in turn is constrained by stone shoe 74. Because both shoes are pinned to swing arm 62 by shoe retaining pin 96, swing arm 62 oscillates about the axis formed by the centerline through pins 64 in addition to rotating about the axis of the honing machine spindle 70. As cam follower rollers 78 rotate against stationary cam 42, the resulting combination of motions generates the desired bore shape at the face of honing stone 72. Additionally, as it rotates, the entire assembly shown in FIG. 1 oscillates up and down while the mechanism 12 is within the cylinder bore and produces a crosshatched honing pattern.

As the four stone shoes 74 are alternately expanded and contracted by cam follower rollers 78 tracing the surface of stationary cam 42, the length of the four springs 100 that make up each "parallelogram " remains nearly constant. As one spring anchor pin 98 is expanding outward, the spring anchor pins 98 on both sides of it are contracting inward at nearly the same rate. Consequently, spring force on the mechanism is nearly constant at all rotation angles.

The upper end of an expansion control rod 102 is connected by connector 16 to a controllable adjustment mechanism inside the honing machine spindle not shown. An elliptical (or non round) shaped thrust plate 104 extends around stationary cam 42 and is pinned to the expansion control rod 102 by rod pin 106. Pin 106 passes through a vertical clearance slot 108 in stationary cam 42.

As stock removal or stone wear occurs, expansion control rod 102 and thrust plate 104 are driven downward by the expansion adjustment mechanism of the honing machine, not shown. Thrust plate 104 engages a notch 110 in each of the four expansion shoes 80 and drives them in the same direction simultaneously. As expansion shoes 80 are forced downward, wedge surfaces 86, 88 drive stone shoes 74 horizontally outward to remove more stock or compensate for wear on honing stones 72.

Before the start and after the finish of the honing operation, expansion control rod 102 is moved upward. Thrust plate 104 and all four expansion shoes 80 move in the same direction. Upward movement of the wedge surfaces 86 on expansion shoes 80 allows extension springs 100 to contract all four stone shoes 74 so that the non round cylinder bore honing mechanism 12 can be inserted or withdrawn from the cylinder bore without scratching its surface finish.

All openings on the exterior of the non round cylinder bore honing mechanism 12 are intentionally kept to a minimum. Lubricant containing coolant is fed into gearbox 24 through a port 112. An annular flow path 114 directs the coolant down to the cylindrical housing 38 of the non round cylinder bore honing mechanism 12. Since openings in mechanism 12 are kept to a minimum, an outward coolant flow can be maintained. In addition to providing lubricant to all moving parts inside of the cylindrical housing 38, the outward flow direction deters abrasive contaminants from entering and prematurely wearing out the moving parts.

To prevent coolant from traveling up into machine adapter 14 through the space 115 between hollow camshaft 28 and tool body 36, a rotating type seal 116 is provided. A witness hole 118 in tool body 36 is located above rotating seal 116 in case the latter should leak.

Figure 9:
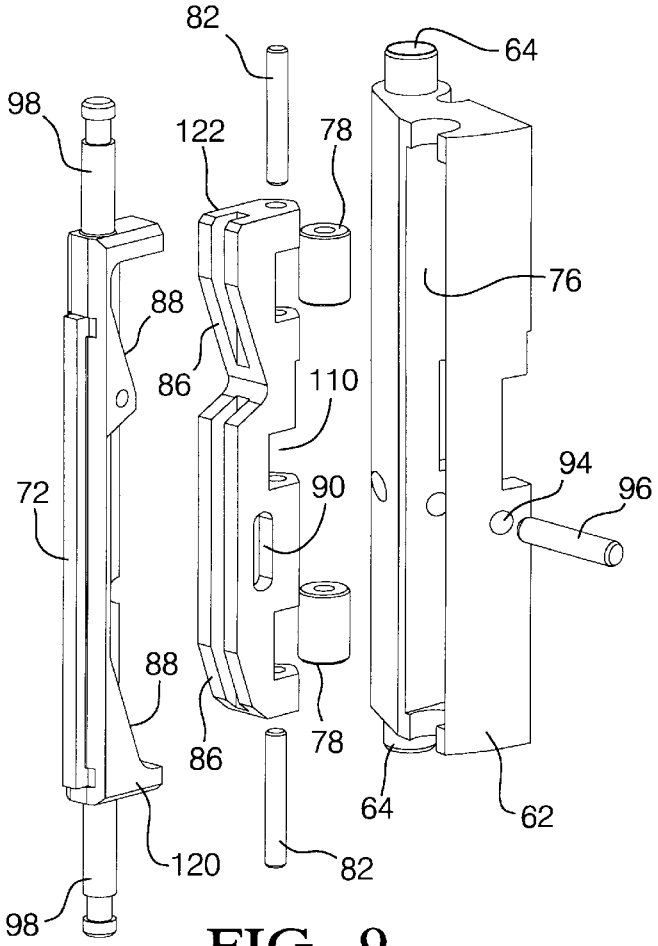
FIG. 9 is an exploded pictorial view showing an alternative embodiment of swing arm assembly.
Figure 10:
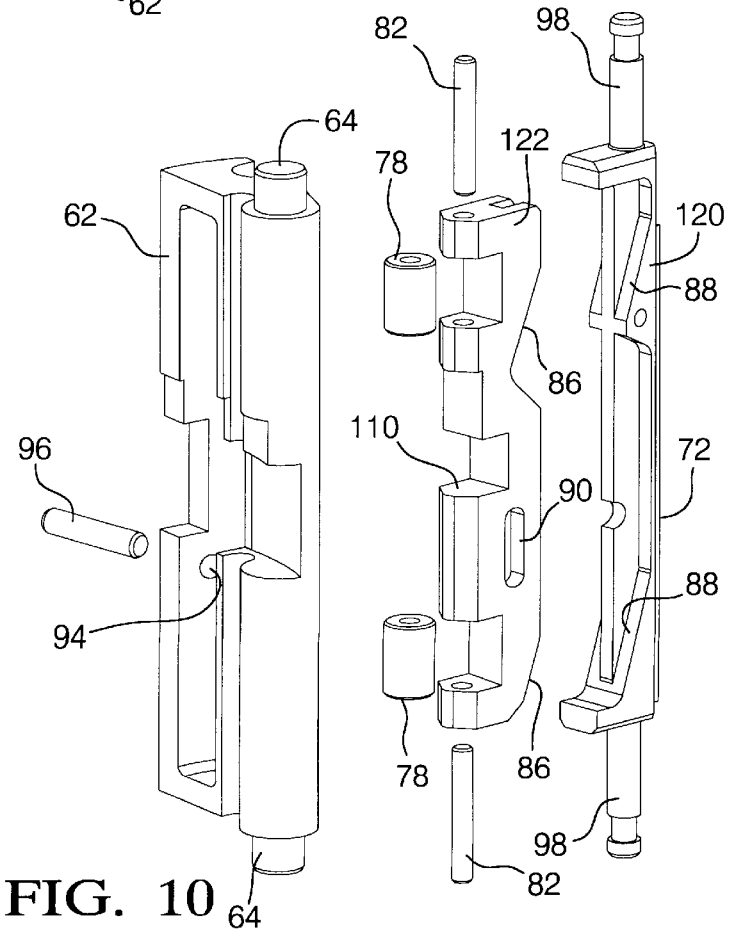
FIG. 10 is an exploded pictorial view of the swing arm assembly of FIG. 9 viewed from the opposite direction.

FIGS. 9 and 10 show an alternate arrangement where stone shoe 74 is replaced with an improved design stone shoe 120. Locating wedge surfaces 86 on the exterior faces of stone shoe 120 makes the part easier to manufacture. To be compatible with stone shoe 120, expansion shoe 80 must also be replaced. FIGS. 9 and 10 show the modified expansion shoe 122 that replaces expansion shoe 80. All other parts are interchangeable between the two designs. Function and operation of the expansion mechanism is the same for both versions.

While the invention has been described by reference to certain preferred embodiments, it should be understood that numerous changes could be made within the spirit and scope of the inventive concepts described. Accordingly it is intended that the invention not be limited to the disclosed embodiments, but that it have the full scope permitted by the language of the following claims.

What is claimed is:

1. A mechanism for honing non round cylinder bores, said mechanism comprising:

a tool body rotatable on an axis and surrounding a nonrotatable camshaft having a non round peripheral cam surface;

a plurality of honing stones carried by supports mounted for generally radial movement in said tool body and operatively engaging said cam surface for causing orbital motion of the honing stones in a prescribed non round configuration for shaping a cylinder bore upon rotation of the tool body; and a separately controlled expansion actuator for selectively adjusting the radial position of the honing stones relative to the peripheral cam surface to progressively remove stock from an associated cylinder workpiece and to compensate for wear in the honing stones.

2. A mechanism as in claim 1 wherein said supports include slidably mounted stone shoes and said expansion actuator includes axially movable expansion means engaging said stone shoes to extend and retract the stone shoes, at least one of the group consisting of said expansion means and said stone shoes having wedge cams engaging mating follower means on the other of said group.

3. A mechanism as in claim 1 wherein said supports are mounted for pivotal movement in the tool body and said honing stones follow arcuate paths oriented in generally radial directions.

4. A mechanism as in claim 3 wherein said supports include pivotally mounted swing arms carrying slidably mounted stone shoes on which the honing stones are mounted.

5. A mechanism as in claim 4 wherein said expansion actuator includes axially movable expansion shoes carried in said swing arms between said peripheral cam surface and said stone shoes and operatively connecting the stone shoes with the cam for driving the stone shoes in said non round configuration, at least one of the group consisting of said expansion shoes and said stone shoes having wedge cams engaging mating follower means on the other of said group, said expansion shoes being axially movable to radially extend or retract the stone shoes.

6. A mechanism as in claim 5 wherein said expansion actuator also includes guides radially connecting the swing arms with their respective expansion shoes for maintaining their relative axial positions.

7. A mechanism as in claim 6 wherein said guides comprise pin and slot connections limiting relative radial motion but allowing axial motion of the expansion shoes relative to their respective swing arms.

8. A mechanism as in claim 5 wherein said expansion actuator further includes:

a control rod connectable with external control means and axially movable within a hollow center of said camshaft; and means connecting the control rod with the expansion shoes for causing axial motion thereof.

9. A mechanism as in claim 1 and including a coolant passage within the tool body and operative to direct coolant against internal portions of said mechanism, said tool body enclosing said internal portions of the mechanism and having limited external communication to maintain an outward coolant flow which prevents entry of chips and abrasive particles and minimizes wear of said internal portions.

10. An assembly comprising a mechanism as in claim 1 and a machine adapter drivably connected with said mechanism and adapted for connecting said mechanism with a honing machine, the machine adapter including:

a gearbox attachable to a honing machine in a manner to limit movement of the gearbox to an axial direction, said camshaft being fixed to and supported by said gearbox; and a gear train in said gearbox and connected with a rotatable coupling connectable with a rotatable drive of the honing machine and connected with said tool body for rotation of the tool body on said axis.

11. An assembly as in claim 10 wherein said gearbox includes a housing that is connected with said camshaft and is connectable with external means for preventing rotation of the gearbox and camshaft in use.

* * * * *